United States Patent [19]

Cook

[11] 4,094,502

[45] June 13, 1978

[54] SKIPPING EXERCISE DEVICE

[76] Inventor: Arthur W. Cook, 822 Roosevelt St., Lima, Ohio 45804

[21] Appl. No.: 766,189

[22] Filed: Feb. 7, 1977

[51] Int. Cl.[2] ..... A63B 5/22

[52] U.S. Cl. ..... 272/74

[58] Field of Search ..... 272/74, 75, 144; 297/29, 27, 285, 382, 441; 5/68, 200 R

[56] References Cited

U.S. PATENT DOCUMENTS

| | | | |
|---|---|---|---|
| 2,723,121 | 11/1955 | Cartwright et al. | 272/75 |
| 3,064,971 | 11/1962 | Feinn | 272/75 |
| 3,064,972 | 11/1962 | Feinn | 272/75 |
| 3,466,032 | 9/1969 | Thornton | 272/74 |
| 3,633,925 | 1/1972 | Deese | 272/75 |
| 3,958,802 | 5/1976 | Thornton | 272/74 |

FOREIGN PATENT DOCUMENTS

| | | | |
|---|---|---|---|
| 816,571 | 7/1969 | Canada | 272/74 |
| 263,999 | 9/1949 | Switzerland | 272/75 |

*Primary Examiner*—Richard C. Pinkham
*Assistant Examiner*—Arnold W. Kramer
*Attorney, Agent, or Firm*—Oliver E. Todd, Jr.

[57] ABSTRACT

A skipping exercise device is disclosed. The device comprises a rectangular frame formed from a lightweight synthetic resinous material to define two long sides and two short sides. The two long sides are each hinged at points equidistant from a first short side located from such first short side between one-ninth and one-third the length of the long sides. An abrasion resistant sleeve is positioned over such first short side and, optionally, a rotatable handle is positioned over the second short side.

9 Claims, 7 Drawing Figures

SKIPPING EXERCISE DEVICE

BACKGROUND OF THE INVENTION

This invention relates to exercise devices and more particularly to a skipping exercise device which imparts a rowing motion to the arms and shoulders of a user in addition to exercising the user's legs.

Skipping rope is a favorite form of entertainment for children and particularly for young girls. Rope skipping is also used as a training exercise for many athletes, such as boxers, for exercising the legs and the cardiovascular system. However, rope skipping provides relatively little exercise for the arms and shoulders of a person.

SUMMARY OF THE INVENTION

According to the present invention, an improved skipping exercise device is provided for exercising the arms and shoulders of the user in addition to the user's legs and cardiovascular system. The device generally consists of a rectangular frame which is preferably made from a synthetic resinous material. The rectangular frame has two long sides and two short sides. A first one of the short sides is designed to be grasped as a handle. A hinge is located at a predetermined point in each long side. The predetermined points in the two long sides are equally spaced from the second one of the short side at a distance of from one-ninth to one-third the length of the long sides. Preferably, the hinge resiliently urges the long sides to straight positions coplanar with the short sides while permitting the second short side to swing about the hinge points. Preferably, a sleeve or coating of abrasion resistant synthetic resinous material is applied to the second short side to prevent excessive wear when such side strikes the ground during use of the device. The device is used by grasping the first short side and swinging such that the rectangular frame passes around the user's body. The second short side strikes the ground in front of the user's feet. The user then moves his arms and shoulders in a rowing motion to cause the second short side to slide under his feet while he simultaneously jumps. In a modified embodiment, a handle is positioned over the first short side to rotate coaxially with respect to the first short side. The handle may simply consist of a hollow tube having an internal diameter slightly greater than the external diameter of the first short side. In addition to providing a rowing motion to the user's arms, the device may also be used for trick jumping. For example, the device may be positioned to a side of the user and rotated about the sides of the user rather than the front and back of the user. This is not possible with a conventional skipping rope.

Accordingly, it is an object of the invention to provide a novel skipping exercise for exercising the arms and shoulders of the user in addition to the user's legs and cardiovascular system.

Other objects and advantages of the invention will become apparent from the following detailed description, with reference being made from the accompanying drawings.

DESCRIPTION OF THE PREFERRED EMBODIMENTS

Figure 1:
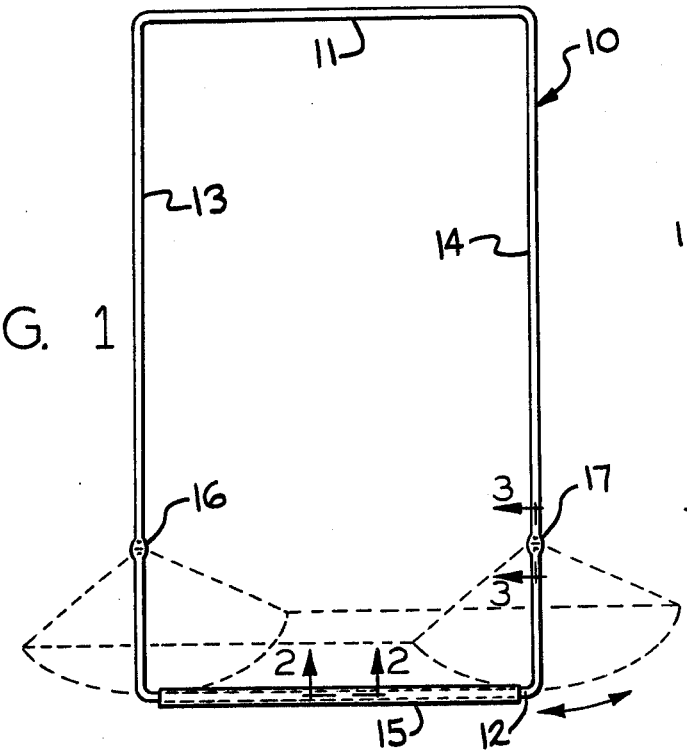
FIG. 1 is a front elevational view of a skipping exercise device constructed in accordance with one embodiment of the invention.

Turning now to the drawings and particularly to FIG. 1, a skipping exercise device 10 constructed in accordance with a first embodiment of the present invention is shown in elevation. The skipping device 10 is in the general form of a rigid rectangular frame having two short sides 11 and 12 and two long sides 13 and 14. The short side 11 is provided with a round exterior to define a handle for grasping by a user of the device 10. The short side 12 is adapted to strike the ground during use and, preferably, is protected by an abrasion resistant sleeve 15. A hinge 16 is formed integrally in the side 13 and a hinge 17 is formed integrally in the side 14. The hinges 16 and 17 are formed in the long sides 13 and 14 equidistant from the short side 12 and are spaced from the short side 12 a distance ranging from one-ninth to one-third the length of the long sides 13 and 14.

Figure 3:
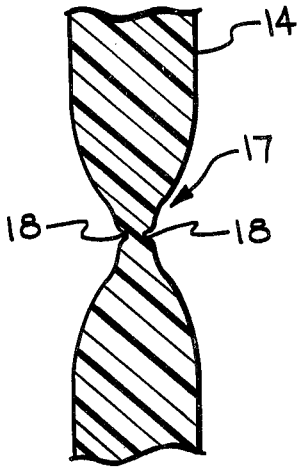
FIG. 3 is a fragmentary cross sectional view taken along line 3—3 of FIG. 1.

Turning for a moment to FIG. 3, a cross sectional view is shown through the hinge 17 in the long side 14. In this embodiment of the invention, the skipping exercise device 10 is molded from a synthetic resinous material, such as a polyethylene, which provides rigidity for the short sides 11 and 12 and the long sides 13 and 14 yet has the flexibility and resiliency properties necessary for the hinge 17. The hinge 17 may be either molded at the same time the device 10 is molded or it may be formed after the device 10 is molded by pressing flat parallel creases 18 into opposite sides of the side 14 with a heated iron. The creases 18 extend coplanar and parallel with the short sides 11 and 12.

Preferably, the synthetic resinous material from which the device 10 is formed has sufficient resiliency to normally bias the long sides 13 and 14 to a straight position such that they are straight and extend coplanar with the short sides 11 and 12. During use of the device 10, whenever the short side 12 strikes the ground, the short side 12 swings about the hinges 16 and 17, as represented by the dashed line in FIG. 1.

Figure 2:
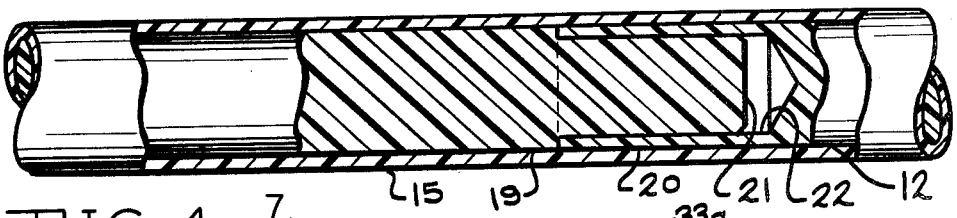
FIG. 2 is a fragmentary cross sectional view taken along line 2—2 of FIG. 1.

The protective sleeve 15 on the short side 12 is preferably formed from a highly abrasion resistant synthetic resinous material. The sleeve 15 may be molded directly onto the short side 12. Or, as shown in the cross sectional view of FIG. 2, a joint is formed in the middle of the short side 12. The short side 12 is formed to define an end 19 and an end 20. A pin 21 projecting from the end 19 fits within an opening 22 in the end 20. The device 10 is assembled by inserting the ends 19 and 20 in opposite ends of the sleeve 15 and pressing or otherwise permanently locking the pin 21 in the opening 22.

During operation of the skipping exercise device 10, a user grasps the handle end 11, placing one hand on the end 11 adjacent the long side 13 and the other hand on the end 11 adjacent the long side 14. The handle end 11 is grasped sufficiently loose to permit the end 11 to rotate within the user's hands. The user then swings the device 11 about his body such that the end 12 passes over the user's head and eventually strikes the ground in front of the user's feet. At this point, the end 12 swings or pivots at the hinges 16 and 17. At the same time, the user pulls the handle 11 towards his body in a rowing like motion to drag the end 12 under his feet as he simultaneously jumps. By providing the hinges 16 and 17 in the long sides 13 and 14 and allowing the lower end 12 to strike the ground, the user must exercise his arms and shoulders at the same time he exercises his legs. The exercise is sufficiently vigorous to also exercise the user's cardiovascular system.

Figure 4:
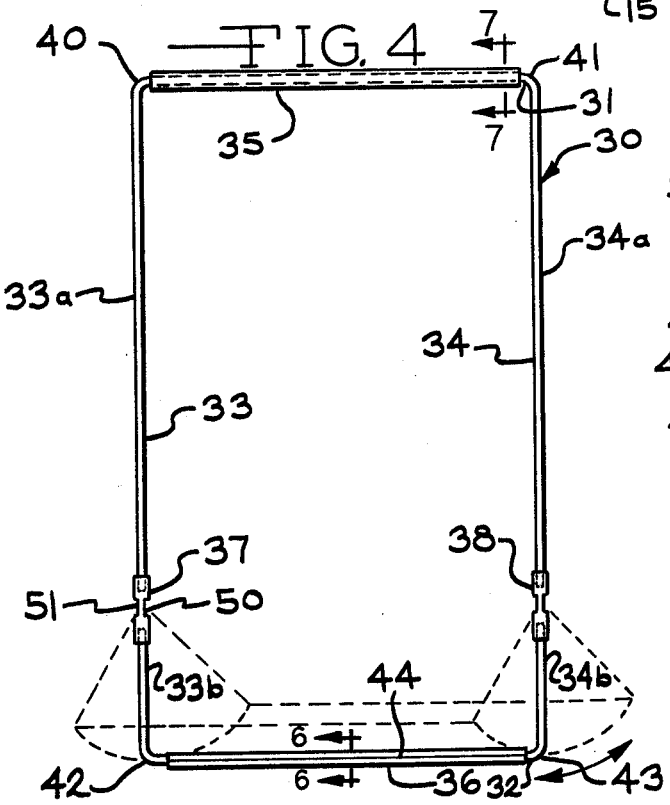
FIG. 4 is a front elevational view of a modified embodiment of a skipping exercise device constructed in accordance with the present invention.

Turning now to FIG. 4, a skipping exercise device 30 is shown in accordance with a modified embodiment of the invention. Again, the device 30 is in the general form of a rectangular frame having two short sides 31 and 32 and two long sides 33 and 34. A rotatable handle 35 is provided on the short side 31 and an abrasion resistant sleeve 36 is provided on the short side 32. Hinges 37 and 38 are provided, respectively, in the long sides 33 and 34. The hinges 37 and 38 are spaced equidistant from the short side 32 and are located a distance from the short side 32 of from one-ninth to one-third the length of the long sides 33 and 34. The hinges 37 and 38 are sufficiently flexible as to permit the short side 32 to swing, as shown by the dashed lines in FIG. 4.

Figure 7:
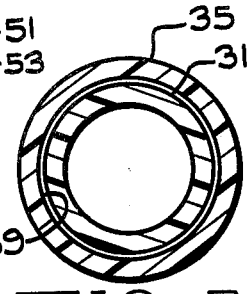
FIG. 7 is a cross sectional view taken along line 7—7 of FIG. 4.
Figure 6:
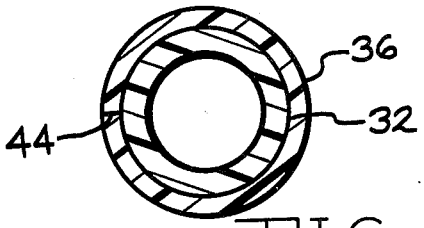
FIG. 6 is a cross sectional view taken along line 6—6 of FIG. 4.

In the embodiment of the device 30 shown in FIG. 4, the frame sides 31–34 are formed from tubes of a rigid, thermoplastic synthetic resinous material. An upper portion **33*a* of the long side 33 located above the hinge 37, the short side 31 and an upper portion 34*a* of the long side 34 located above the hinge 38 are integrally formed from a tube of the synthetic resinous material. As shown in FIGS. 4 and 7, the handle 35 consists of a hollow tube, also of a synthetic resinous material, which is positioned coaxially on the short end 31. The tube forming the handle 35 has an interior opening 39 of a diameter slightly larger than the exterior diameter of the short side 31 to permit the short side 31 to rotate coaxially within the handle 35. During manufacture, the handle 35 is inserted onto the tube from which the sides 33*a*, 31 and 34*a* are integrally formed. The tube from which these sides are formed has been locally heated and bent to form a right angle 40 between the sides 33*a* and 31 and a right angle 41 between the sides 31 and 34*a*. Similarly, the side 32 is integrally formed with a lower portion 33*b* of the side 33 and a lower portion 34*b* of the side 34 which are located, respectively, below the hinges 37 and 38. The tube from which the sides 33*b*, 32 and 34*b* are formed is locally heated and bent to form right angles 42 and 43. The abrasion resistant sleeve 36 may be positioned on the tube from which the sides 33*b*, 32 and 34*b* are formed prior to bending the angles 42 and 43. Or, as shown in FIGS, 4 and 6, the sleeve 36 may be provided with a longitudinal cut or slit 44. The sleeve 36 is then opened at the slit 44 and positioned over the short side 32. If desired, a suitable adhesive may be placed either on the short sides 32 or on the interior of the sleeve 36 prior to positioning the sleeve 36 on the short side 32 to permanently bond the sleeve 36** in place.

Figure 5:
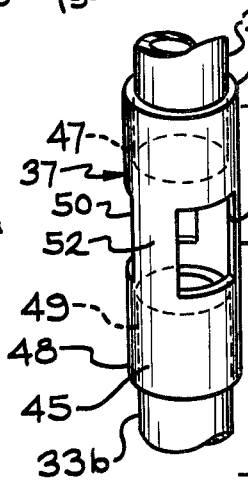
FIG. 5 is a fragmentary perspective view showing a hinge in the device of FIG. 4.

Referring now to FIGS. 4 and 5, the hinge 37 is shown in detail. The hinge 37 consists of a tubular sleeve 45 formed from a flexible yet resilient synthetic resinous material. The sleeve 45 includes an upper end 46 which fits over a lower end 47 of the upper long side portion **33*a* and a lower end 48 which fits over an end 49 of the lower long side portion 33*b*. The sleeve 45 is bonded to or otherwise tightly engages the long side portions 33*a* and 33*b* while holding the ends 47 and 49 spaced apart a short distance. Rectangular cutouts 50 and 51 are located in the sleeve 45 between the spaced ends 47 and 49. The cutout 50 is directed towards the side 34 while the cutout 51 is directed away from the side 34. Two generally parallel spaced strips 52 and 53 remain in the sleeve 45 between the cutouts 50 and 51. The cutouts 52 and 53 are sufficiently flexible to permit the lower short side 32 to swing or pivot about the hinge 37 while preventing the short side 32 from moving in an axial direction. The resiliency of the hinge 37 is sufficient to bias the short side 32 towards a position wherein the sides 31, 32, 33 and 34** are coplanar.

In operation, a user grasps the handle 35 and swings the device 30 such that the short end 32 swings about his body, over his head, and strikes the ground in front of his feet. When the short side 32 strikes the ground, the user moves the handle 35 towards his body in a rowing type motion to drag the short side 32 under his feet as he simultaneously skips or jumps. If the user does not jump at the proper time, the short side 32 will strike the user's ankles and may trip the user. The device 30 may also be operated in a reverse direction such that the short side 32 strikes the ground behind the user's feet. Or, unlike a convention skip rope, the device 30 may be rotated sidewise to the user, striking the ground to one side of the user's feet.

It will be appreciated that various modifications and changes may be made to the above described embodiments of a skipping exercise device without departing from the spirit and the scope of the following claims. For example, the device 10 may be made from either solid or hollow tubular stock material. Furthermore, the device may be constructed from a single piece of material having integral hinges or may be made from a plurality of pieces with separate hinges attached in the long sides. The lower short side of the device may be protected with a sleeve or tube or a coating of an abrasion resistant material or the lower short side may be constructed from heavier material to increase the life of the device. Where desired, the upper short side may be provided with handles which are rotatably mounted with respect to the frame of the device. The hinges in the long sides are preferably designed to resiliently urge the long sides to straight positions wherein they extend coplanar with the short sides. However, the exercise device will operate with free hinges since centrifugal force will tend to straighten the long sides as the device is used.

What I claim is:

1. A skipping exercise device comprising a rectangular frame having two rigid long sides and two rigid short sides, a first of said short sides having means defining a handle, and hinge means located at a fixed predetermined point in each long side, said predetermined points being equally spaced from the second of said short sides a distance of from one-third to one-ninth the length of said long sides, said hinge means permitting said second short side to swing about said predetermined points in said long sides.

2. A skipping exercise device, as set forth in claim 1, wherein said handle means comprises tubular means mounted on said first short side to rotate coaxially with respect to said first short side.

3. A skipping exercise device, as set forth in claim 2, and further including means protecting said second short side from abrasive wear when said second short side strikes the ground during use of said device.

4. A skipping exercise device, as set forth in claim 3, wherein said protecting means comprises a sleeve of abrasion resistant synthetic resinous material positioned over said second short side.

5. A skipping exercise device, as set forth in claim 1, and further including means protecting said second short side from abrasive wear when said second short side strikes the ground during use of said device.

6. A skipping exercise device, as set forth in claim 5, wherein said protecting means comprises a sleeve of abrasion resistant synthetic resinous material positioned over said second short side.

7. A skipping exercise device, as set forth in claim 1, wherein said hinge means in each long side comprises an integral thin resilient area in such long side.

8. A skipping exercise device, as set forth in claim 1, wherein said handle means comprises a rounded exterior surface on said first short side.

9. A skipping exercise device, as set forth in claim 1, wherein said hinge means includes means resiliently urging said long sides to positions coplanar with said short sides.

* * * * *